US005510175A

United States Patent [19]

Shiozawa

[11] Patent Number: 5,510,175

[45] Date of Patent: Apr. 23, 1996

[54] POLISHING CLOTH

[75] Inventor: Kenichiro Shiozawa, Kyoto, Japan

[73] Assignee: Chiyoda Co., Ltd., Kyoto, Japan

[21] Appl. No.: 396,929

[22] Filed: Mar. 1, 1995

Related U.S. Application Data

[63] Continuation-in-part of Ser. No. 148,312, Nov. 8, 1993, abandoned.

[51] Int. Cl.[6] ..... B24D 3/32

[52] U.S. Cl. ..... 428/288; 15/209.1; 15/210.1; 428/290

[58] Field of Search ..... 521/64; 15/209.1, 15/210.1; 428/280, 287, 288, 290, 289

[56] References Cited

U.S. PATENT DOCUMENTS

| | | | |
|---|---|---|---|
| 3,067,482 | 12/1962 | Hollowell | 28/74 |
| 3,504,457 | 4/1970 | Jacobson et al. | 51/131 |
| 3,701,681 | 10/1972 | Murphy et al. | 521/64 X |
| 3,769,381 | 10/1973 | Konig et al. | 521/64 X |
| 4,207,128 | 6/1980 | Traubel et al. | 521/64 X |
| 4,208,486 | 6/1980 | Patton | 521/64 X |
| 4,627,936 | 12/1986 | Gould et al. | 428/289 X |
| 4,728,552 | 3/1988 | Jensen, Jr. | 428/91 |
| 4,927,432 | 5/1990 | Budinger et al. | 428/283 X |
| 5,094,914 | 3/1992 | Figuby et al. | 521/64 X |
| 5,171,308 | 12/1992 | Gallagher et al. | 428/36.4 X |

*Primary Examiner*—Jenna L. Davis
*Attorney, Agent, or Firm*—Barnes, Kisselle, Raisch, Whoate, Whittemore & Hulbert

[57] ABSTRACT

A nonwoven cloth 1 comprising 100% vinal filaments is bonded and fixed with microporous aromatic polysulfone resin 6 incorporating fine through-holes 5 by the steps of; impregnating the nonwoven cloth 1 with an aromatic polysulfone resinous solution 3 prepared by dissolving the aromatic polysulfone resin in an organic solvent, subsequently immersing the cloth 1 impregnated with the aromatic polysulfone resinous solution 3 in a nonsolvent 4 so as to coagulate the aromatic polysulfone resinous solution 3, afterwards washing the cloth 1 with water, and finally drying the cloth 1. The polishing cloth 7 comprises this nonwoven cloth 1 bonded and fixed with the microporous aromatic polysulfone resin 6. Therefore, as far as the polishing cloth 7 is used, the porous structure of the resin is free from being deformed by heat and pressure added to the cloth during the polishing process and clogging of the polishing particles can also be prevented. As a result, good polishing performance can be maintained without being threatened to deteriorate.

2 Claims, 2 Drawing Sheets

POLISHING CLOTH

REFERENCE TO RELATED APPLICATION

This application is a continuation-in-part of application, Ser. No. 08/148,312, filed Nov. 8, 1993, now abandoned.

FIELD OF THE INVENTION

The present invention relates to a polishing cloth used for polishing surfaces of metal, semiconductor substrates, glass, etc., with utmost precision.

BACKGROUND OF THE INVENTION

Conventionally, in order to polish surfaces of metal, semiconductor substrates made from silicon, gallium arsenide and others, glasses, ceramics, etc., with utmost precision, polishing clothes have been used for a primary polishing process and a secondary polishing process which are executed before executing a final polishing process. Such a polishing cloth is produced by the steps of impregnating a nonwoven cloth with a solution of polyurethane resin and coagulating the resin-impregnated nonwoven cloth by immersing it in water which is substantially a nonsolvent. The nonwoven cloth is bonded and fixed with porous polyurethane resin having a multiplicity of fine through holes. According to this conventional polishing cloth, the porous structure of the polyurethane resin functions both to hold the polishing solution therein and to discharge the solution therefrom.

On the other hand, the porous polyurethane resin is apt to be deformed by pressure and heat generated while executing polishing. The use of the porous polyurethane resin often causes deterioration of the polishing performance because polishing particles clog themselves in the fine through holes. Also the surfaces of to-be-polished objects are caused to scratch. This, the conventional polishing cloth has problems regarding its quality and productivity. In addition, in recent years, a demand for high-pressure high-speed polishing has been increasing so rapidly that overall improvement of the polishing cloth is required urgently.

DISCLOSURE OF THE INVENTION

The object of the invention is to provide a novel polishing cloth featuring incomparable quality, satisfactory productivity, and good resistance to wear. According to the invention, the porously structured novel cloth is free from being deformed by pressure and heal; generated in the course of polishing, and polishing particles do not clog themselves in the porous structure of the cloth. With the novel polishing cloth, therefore, the surface of a polished object neither streaks nor scratches. Further, the polishing performance by the novel polishing cloth will not diminish during its service life.

In order to achieve the object, the polishing cloth according to the invention comprises a nonwoven cloth comprising 100% vinal filaments which is bonded and fixed with microporous aromatic polysulfone resin, characterized in that the nonwoven cloth is first impregnated with an aromatic polysulfone resinous solution prepared by dissolving the aromatic polysulfone resin in an organic solvent, the nonwoven cloth impregnated with the aromatic polysulfone resinous solution is subsequently immersed in a nonsolvent so as to coagulate the aromatic polysulfone resinous solution, and the, nonwoven cloth is afterwards washed with water and dried.

According to this construction, the polishing cloth comprises a nonwoven cloth bonded and fixed with the microporous aromatic polysulfone resin. By virtue of properties of the aromatic polysulfone resin such as outstanding thermal resistance and extremely high resistance against thermal deformation, even when high-pressure high-speed polishing is executed, the aromatic polysulfone resin impregnated in the cloth is free from being deformed by the heat and pressure added to the cloth while executing polishing, thereby preventing its porous structure from being damaged. Therefore, there occurs no clogging of the polishing particles, and the surface of the polished object is free of streaks or scratches. As a result, the novel polishing cloth can maintain predetermined polishing performance constantly without deterioration at all. Therefore, the invention provides a polishing cloth of superior quality and high productivity.

Further, the aromatic polysulfone resin is superior to the polyurethane resin in self-dressing, so that substantial working efficiency can be improved without dressing the aromatic polysulfone resin. In addition, with the aromatic polysulfone resin which can be coagulated to be multiporous, it is possible to freely adjust the diameter and shape of the through holes, the rate of provision of the through holes, the strength of the cloth, etc., so that the performance of the polishing cloth can be controlled with ease.

In order to achieve the object of the invention otherwise, the polishing cloth may comprise a nonwoven cloth comprising 100% vinal filaments which is bonded and fixed with a microporous resinous mixture off the aromatic polysulfone resin and the polyurethane resin, characterized in that the nonwoven cloth is first impregnated with a mixed resinous solution prepared by dissolving the aromatic polysulfone resin and the polyurethane resin in an organic solvent, the nonwoven cloth impregnated with the mixed resinous solution is subsequently immersed in a nonsolvent so as to coagulate the mixed resinous solution, and the nonwoven cloth is afterwards washed with water and dried.

According to this construction, the nonwoven cloth is bonded and fixed with the mixed resin of the microporous aromatic polysulfone resin and the polyurethane resin, so that the aromatic polysulfone resin and the polyurethane resin can mutually compensate respective drawbacks, that is, by the effect of such properties of the aromatic polysulfone resin as outstanding thermal resistance and durability against thermal deformation under very high temperature, as well as by the effect of such properties of the polyurethane resin as excellent wear-resistance and elasticity.

Furthermore, based on the mixture ratio between the aromatic polysulfone resin and the polyurethane resin, performance characteristics of the porous mixed resinous body can optionally be adjusted. Therefore, it is possible to provide an optimal polishing cloth by properly adjusting the mixture ratio between the aromatic polysulfone resin and the polyurethane resin in accordance with the physical properties of the material of a to-be-polished object, the conditions for executing polishing, and the degree of quality demanded for. It is possible to control with ease and widely the performance characteristics of the polishing cloth by way of freely adjusting the fine through holes with respect to the diameter, shape, strength and the rate of provision thereof, as well as by way of properly adjusting the performance characteristics based on the mixture ratio between the aromatic polysulfone resin and the polyurethane resin.

DESCRIPTION OF THE PREFERRED EMBODIMENTS

Referring to the accompanying drawings, full aspects of the novel polishing cloth according to the invention are described below.

Figure 1:
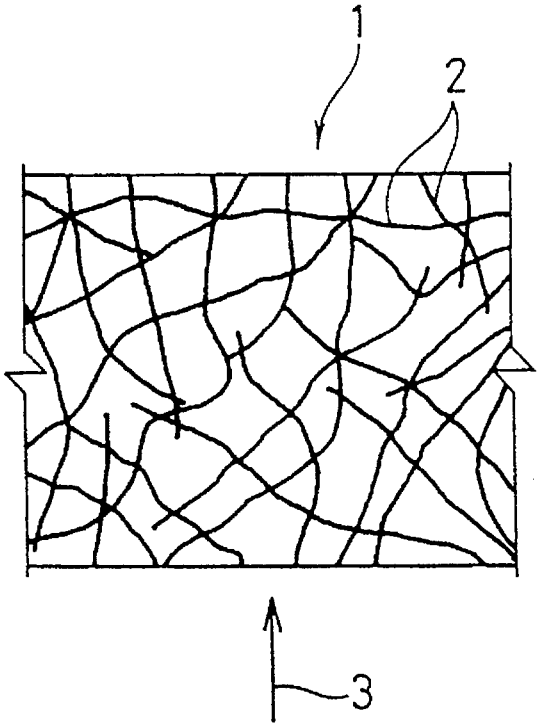
FIG. 1 is a superficial view of a fundamental portion of a nonwoven cloth used for the polishing cloth according to a preferred embodiment of the invention.
Figure 2:
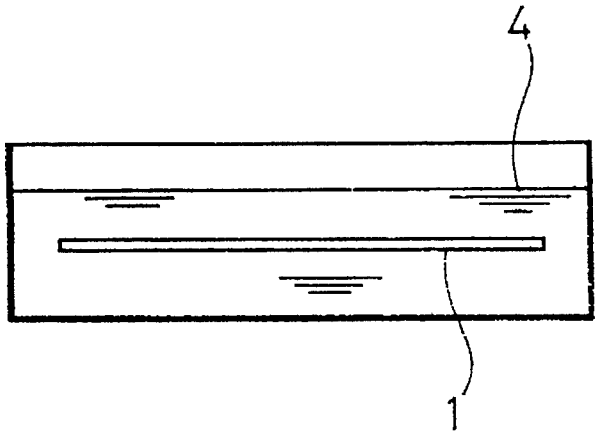
FIG. 2 is an explanatory view illustrating the nonwoven cloth in the process of coagulation in solution.
Figure 3:
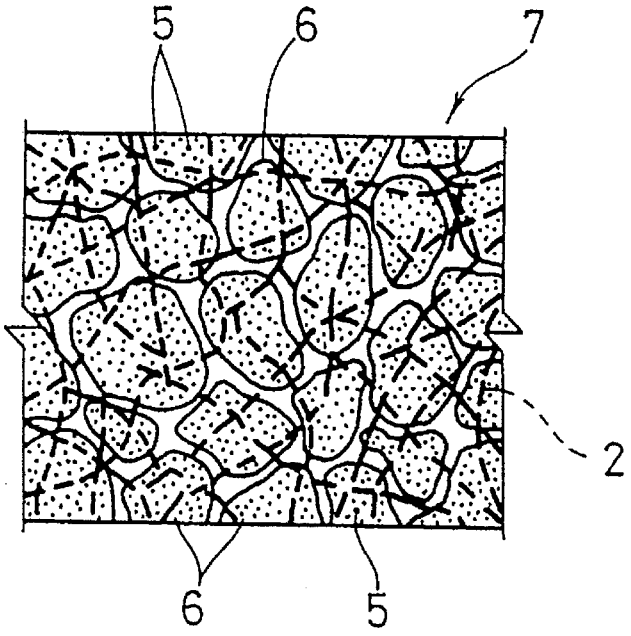
FIG. 3 is a superficial view of a fundamental portion of the polishing cloth.
Figure 4:
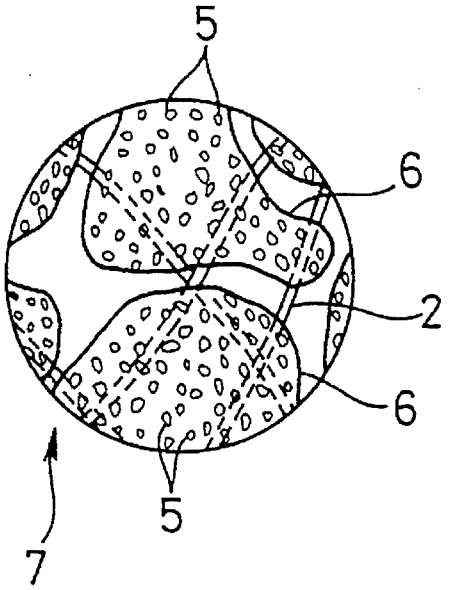
FIG. 4 is an enlarged view of the fundamental portion of the polishing cloth shown in FIG. 3.

According to the first embodiment, a nonwoven cloth 1 shown in FIG. 1 comprises two groups of 100% vinal filaments, long and short. Initially, the nonwoven cloth 1 is impregnated with an aromatic polysulfone resinous solution 3 prepared by dissolving aromatic polysulfone resin in an organic solvent such as dimethylformamide or dimethylpyrrolidone, for example. Subsequently, as shown in FIG. 2, the nonwoven cloth 1 is immersed in water 4 which is a nonsolvent so as to coagulate the aromatic polysulfone resinous solution 3. Afterwards, the cloth 1 is washed with water and dried. As a result, as shown in FIGS. 3 and 4, the polishing cloth 7 comprises the two groups of 100% vinal filaments bonded and fixed with a multiporous aromatic polysulfone resin 6 incorporating a multiplicity of fine through holes 5.

Referring to FIGS. 1 through 4, the second embodiment of the invention is described below.

According to the second embodiment, the nonwoven cloth 1 comprising the two groups of 100% vinal filaments is impregnated with a mixed resinous solution 3 prepared by dissolving the aromatic polysulfone resin and the polyurethane resin in an organic solvent such as the dimethylformamide, for example. Subsequently, the nonwoven cloth 1 is immersed in water 4 which is a nonsolvent so as to coagulate the mixed resinous solution 3, and afterwards dried. As a result, the polishing cloth 7 comprises the two groups of 100% vinal filaments bonded and fixed with a multiporous mixed resin 6 incorporating a multiplicity of fine through holes 5 and composed of the aromatic polysulfone resin and the polyurethane resin.

In these embodiments, the aromatic polysulfone resin used for the polishing cloth is a polysulfone such as udel-polysulfone or polyether sulfone. "Udel" is a trademark of Amoco Performance Products Inc.. The polysulfone marketed as Udel-polysulfone may be fully expressed by the following chemical reaction formula:

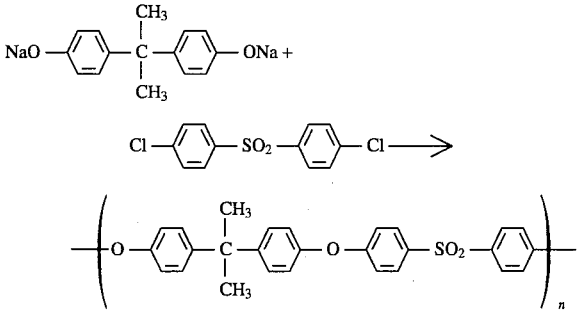

The polyether sulfone may be expressed as follows:

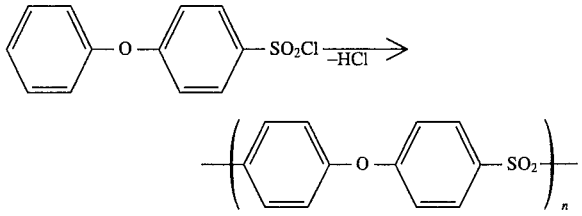

The polyurethane resin is a urethane polymer. Such a polyurethane resin as of ester type or ether type is applicable here in the second embodiment.

It is also possible to manufacture the polishing cloth 7 as follows: the nonwoven cloth 1 is first soaked in a bath of polysulfone resinous solution 3 or a mixed resinous solution 3 while being transferred, then passed through a roll-type squeezer, subsequently immersed in water 4 to be coagulated, and finally dried. In this case, the polishing cloth can be manufactured continuously.

Described below are the examples to embody the polishing cloth of the invention.

EXAMPLE 1

Initially, a needling nonwoven cloth comprising 2.0-denier 100% vinal filaments was soaked in a resinous solution having 16% by weight of solid content of polyether sulfone resin (a product of ICI) which was previously dissolved in dimethylformamide (DMF), where the above needling nonwoven cloth had 250 g/m$^2$ of weight, 0.2 g/cm$^3$ of density, and 1.2 mm of thickness. By this, the nonwoven cloth was impregnated with 120% by weight of solid resinous content. Next, the resin-impregnated nonwoven cloth was immersed in water to be fully coagulated. Afterwards the coagulated nonwoven cloth was washed with fresh water and then dried. As a result, a polishing sheet comprising the nonwoven cloth bonded and fixed with the multiporous polyether sulfone resin was obtained.

Subsequently, the superficial layer of the sheet was removed by means of a slicer, and a polishing cloth having 1.2 mm of thickness, 450 g/m$^2$ of net weight, and 0.38 g/cm$^3$ of density was completed. With this polishing cloth, silicone wafers were polished by way of circulating a polishing solution containing colloidal silica having a mean particle diameter of 0.05 μm. As a result, it was verified that the length of time taken before the polishing cloth started to be clogged is approximately three times longer than that taken when a conventional polishing cloth bonded with the urethane resin was used.

EXAMPLE 2

Initially, a needling nonwoven cloth comprising 1.5-denier 100% vinal filaments was soaked in a resinous solution having 18% by weight of a solid resinous content previously prepared by dissolving the polyether sulfonic resin by 75% and the ether-type polyurethane resin by 25% in the dimethylformamide (DMF), where the needling nonwoven cloth had 220 g/m$^2$ of net weight, 0.18 g/cm$^3$ of density, and 1.25 mm of thickness. By this, the nonwoven cloth was impregnated with 100% by weight of the mixed resins. Next, the nonwoven cloth was immersed in water which is a nonsolvent in order to fully coagulate the mixed resins impregnated therein. Afterwards, the nonwoven cloth was washed with fresh water to remove the solvent therefrom, and then dried. As a result, a sheet comprising a nonwoven vinal cloth bonded and fixed with the aforementioned multiporous mixed resin was completed.

Subsequently, the superficial layer of the sheet was removed by means of a slicer, and a polishing cloth having 1.1 mm of thickness, 420 g/m$^2$ of net weight, and 0.38 g/cm$^3$ of density was obtained. With this polishing cloth, silicone wafers were polished using a polishing solution containing colloidal silica having a mean particle diameter of 0.05 μm. As a result, it was verified that the length of time taken before the polishing cloth started to be clogged is longer by two and half times than that taken when a conventional cloth bonded with the urethane resin was used.

What is claimed is:

1. A polishing cloth comprising a nonwoven cloth comprising 100% polyvinyl alcohol filaments which is bonded with microporous aromatic polysulfone resin, characterized in that:

the nonwoven cloth is first impregnated with an aromatic polysulfone resinous solution prepared by dissolving aromatic polysulfone resin in an organic solvent;

the nonwoven cloth impregnated with the aromatic polysulfone resinous solution is subsequently immersed in a nonsolvent so as to coagulate the aromatic polysulfone resinous solution; and the nonwoven cloth is finally washed with water and dried.

2. A polishing cloth comprising a nonwoven cloth comprising 100% polyvinyl alcohol filaments which is bonded with a microporous resinous mixture of aromatic polysulfone resin and polyurethane resin, characterized in that:

the nonwoven cloth is first impregnated with a mixed resinous solution prepared by dissolving aromatic polysulfone resin and polyurethane resin in an organic solvent;

the nonwoven cloth impregnated with the mixed resinous solution is subsequently immersed in a nonsolvent so as to coagulate the mixed resinous solution; and the nonwoven cloth is finally washed with water and dried.

* * * * *